US005135140A

United States Patent [19]

Maguire et al.

[11] Patent Number: 5,135,140

[45] Date of Patent: * Aug. 4, 1992

[54] SEALABLE AND DISPENSING POURING SPOUT

[76] Inventors: Paul R. Maguire, 4284 Sea View La., Los Angeles, Calif. 90065; John M. Lown, 222 La Jolla La., Newport Beach, Calif. 92663

[ * ] Notice: The portion of the term of this patent subsequent to May 12, 2009 has been disclaimed.

[21] Appl. No.: 741,547

[22] Filed: Aug. 7, 1991

Related U.S. Application Data

[63] Continuation-in-part of Ser. No. 573,629, Aug. 24, 1990.

[51] Int. Cl.[5] ..... B67D 3/00

[52] U.S. Cl. ..... 222/521; 222/519; 222/549; 251/346; 251/352

[58] Field of Search ..... 222/153, 519, 521, 531, 222/532, 542, 548, 549, 552, 568; 215/311, 313; 220/854; 251/252, 343-345, 346, 347, 351-353

[56] References Cited

U.S. PATENT DOCUMENTS

| | | | |
|---|---|---|---|
| 3,131,836 | 5/1964 | Van Baarn | 222/521 |
| 3,216,630 | 11/1965 | Stull | 222/521 |
| 4,842,169 | 6/1989 | Stull | 222/521 |
| 5,000,360 | 3/1991 | Lown et al. | 222/521 |
| 5,044,530 | 9/1991 | Stull | 222/521 |
| 5,067,639 | 11/1991 | Maguire et al. | 222/521 |

FOREIGN PATENT DOCUMENTS

| | | | |
|---|---|---|---|
| 1385000 | 11/1964 | France | 222/521 |

*Primary Examiner*—Michael S. Huppert
*Assistant Examiner*—Philippe Derakshani
*Attorney, Agent, or Firm*—Harold L. Jackson

[57] ABSTRACT

A sealable and dispensing pouring spout is disclosed. A collar member is mounted on a tubular body member, these two parts defining a cam follower surface therebetween. The tubular body member has a stopper attached at an open end thereof. A spout shaped member is rotatably mounted on the tubular body member and has a cam follower which engages the cam follower surface. The spout shaped member can be rotated on the tubular body member into engagement with the stopper member to close the pouring spout or to other positions to open the pouring spout.

7 Claims, 10 Drawing Sheets

SEALABLE AND DISPENSING POURING SPOUT

RELATED APPLICATION

This is a continuation-in-part of our application Ser. No. 07/573,629 filed Aug. 24, 1990.

BACKGROUND OF THE INVENTION

1. Field of the Invention

The invention relates generally to an arrangement for use in dispensing fluids from containers and more particularly to a pouring spout that can be selectively opened or closed to dispense fluids or other materials from a container.

2. Description of Related Art

Many types of fluids are used to lubricate, cool and maintain the smooth operation of cars, trucks, motorcycles, recreational vehicles such as ATV's, and jet skis, lawn mowers and the like. Such fluids, namely, antifreeze, motor oil, transmission fluid, windshield wiper fluid and the like are sold by auto after market shops and supermarkets in standard size containers. In place of the steel cans of yesterday, many of these fluids today are sold and stored in plastic containers which are readily made in large quantities and low cost by plastic molding injection techniques. Hundreds of thousands of pint, quart and gallon containers of the above-mentioned fluids are purchased every year by motorists for use and storage in do it yourself efforts to maintain their own cars, trucks and other vehicles or equipment. Similarly, service stations and garages, that perform routine automobile service and repairs, stock, use and store such fluids for replacement during a maintenance, repair or inspection procedure or to add needed quantities. Spillage of such fluids on the garage floor, sidewalk, lawn or on any surface where such fluids are being dispensed or stored, contributes significantly to the pollution of the environment if they soak into the ground or evaporate into the atmosphere. Furthermore, these automobile fluids easily stain both asphalt and cement driveways and floors which readily absorb such fluids and therefore produce an unsightly mess. Once spilled on these surfaces, oil, antifreeze, transmission fluid, power steering fluid and the like are very difficult if not impossible to clean off such surfaces.

A number of funnel or spouts have evolved over the years for coupling to and dispensing fluids from containers. Typical well known conventional pouring spouts are illustrated in U.S. Pat. Nos. 2,757,831 and 2,736,469 issued to Schmidt and Stone, respectively. These patents disclose spouts for containers, such as gasoline cans, which are formed as a one piece elongated tapering curved tubular spout with an annular flange on the base end of the tubular spout. A screw threaded locking collar mounted over the spout annularly engages the flange and is threaded onto the neck of a container and tightened to hold the flange into tight engagement with the neck. Screw caps threadedly attached to the open end of the spout seal the spout when not in use. Disadvantageously, with these conventional spout structures, it is difficult if not impossible to control or adjust the amount of fluid being dispensed from the container. Overfilling or spillage are therefore inevitable consequences. Furthermore, if the caps are misplaced or lost, the fluids within the container can be spilled from the container if accidentally tipped or evaporate into the atmosphere.

Stopper type mechanisms also evolved that more readily dispense liquids in desired amount as illustrated in U.S. Pat. Nos. 3,305,127; 2,759,643 and 2,591,231 issued to Baranne, Dahlin and Broadway, respectively. The container closure arrangements in these patents, however, are relatively complex and intricate, and therefore the structures disclosed in these patents are expensive to manufacture by standard plastic molding injection techniques.

There is accordingly a need for a reliable, simple, yet inexpensive spout arrangement that is easy to use, dispenses desired amounts of fluids and provides for reliable storage of any quantities remaining in the container.

SUMMARY OF THE INVENTION

It is therefore an object of the invention to provide a spout which is simple in design, easy and inexpensive to manufacture, and durable in construction.

It is another further object of the invention to provide a spout that can be manufactured by low cost plastic molding techniques.

It is still another object of the invention to provide a pouring spout that can be used on standard size containers.

It is an advantage of the invention to provide a spout that can be easily opened or closed during a pouring operation by manipulating the spout with a thumb and finger of one hand.

A sealable and dispensing pouring spout structure for attachment to containers holding oil, antifreeze, transmission fluid and the like according to the present invention comprises three pieces: a tubular body member, a collar member and a spout shaped member which are joined together in a span-together connection arrangement. The tubular body member at one end is provided with an attachment means for securing it to the neck of a standard container, which is typically threaded. At the other end of the tubular body member is a stopper or closure means which is attached thereto. The collar member is fixedly mounted over the tubular body member, and the tubular body member and collar member cooperatively define therebetween a cam surface or slot means. The spout shaped member is rotatably mounted on the tubular body member and has a cam follower or protrusions which engage the cam surface or slot means. By rotating the spout shaped member the cam arrangement causes the spout to move inwardly and outwardly over the tubular body member. The spout shaped member when rotated inwardly cooperates with the stopper or closure means to seal the pouring end of the tubular body member, thereby preventing fluids from being dispensed from the container. On the other hand, when the spout shaped member is rotated outwardly an opening is provided for fluid flow from the container. To prevent material from leaking along the exterior surface of the tubular body member toward the attachment end or collar, the outlet end of the tubular body member is preferably flared outwardly against the inner surface of the spout shaped member.

DESCRIPTION OF THE PREFERRED EMBODIMENTS

Figure 1:
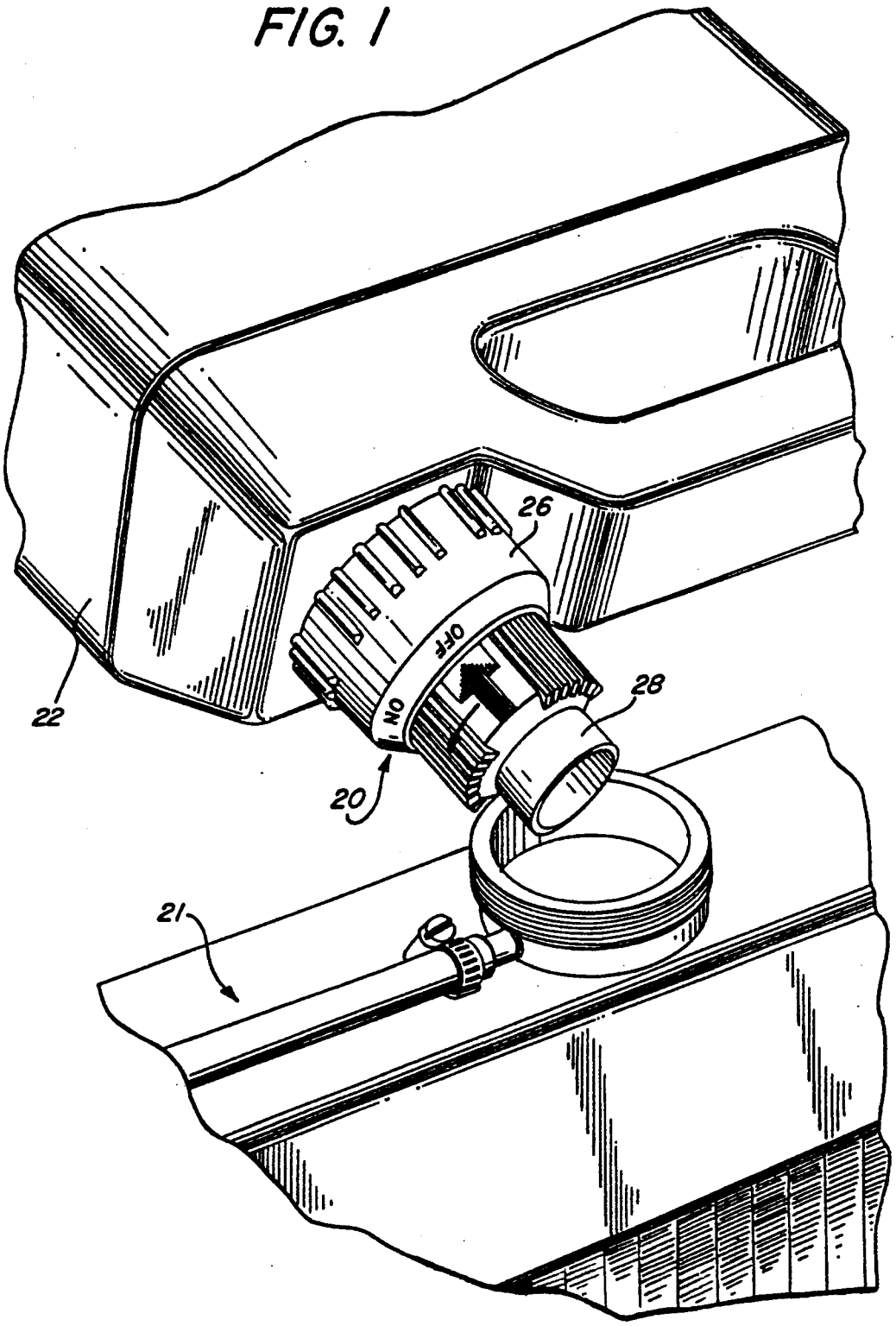
FIG. 1 is a perspective view showing the sealable and dispensing pouring spout mounted on a container in accordance with the principles of the invention.

Referring now with more particularity to the drawings, wherein like or similar parts are designated by the same numerals throughout the various figures, a sealable and dispensing pouring spout arrangement 20 is illustrated in FIG. 1 coupled to a container 22 such as may be used to hold antifreeze, oil, brake fluid, transmission fluid, gasoline or the like. The container is shown in a slightly tipped position for a pouring operation, herein illustrated to a conventional automobile radiator 21 and as such the contents of the container would be antifreeze or water. The spout 20 may be made in any desired size to fit any desired cylindrical neck. Although the dispensing closure may be made of any suitable material, flexible synthetic plastic material is preferred such as polyethylene which is particularly suitable for constructing the pouring spout 20 since it is pliable and resilient and may be deformed slightly so that minor irregularities in structure may be compensated. However, any other material which is resistant to and compatible with the fluid or other matter to be held in the container may also be used as a material for manufacturing the pouring spout.

The pouring spout 20 is composed of three parts: a tubular body member 24 illustrated in FIGS. 2 and 3, a collar member 26 illustrated in FIGS. 4 and 5, and a spout shaped member 28 illustrated in FIGS. 6 and 7, which shall be individually described hereinbelow. These parts may be readily individually made by conventional plastic molding injection techniques.

Figure 3:
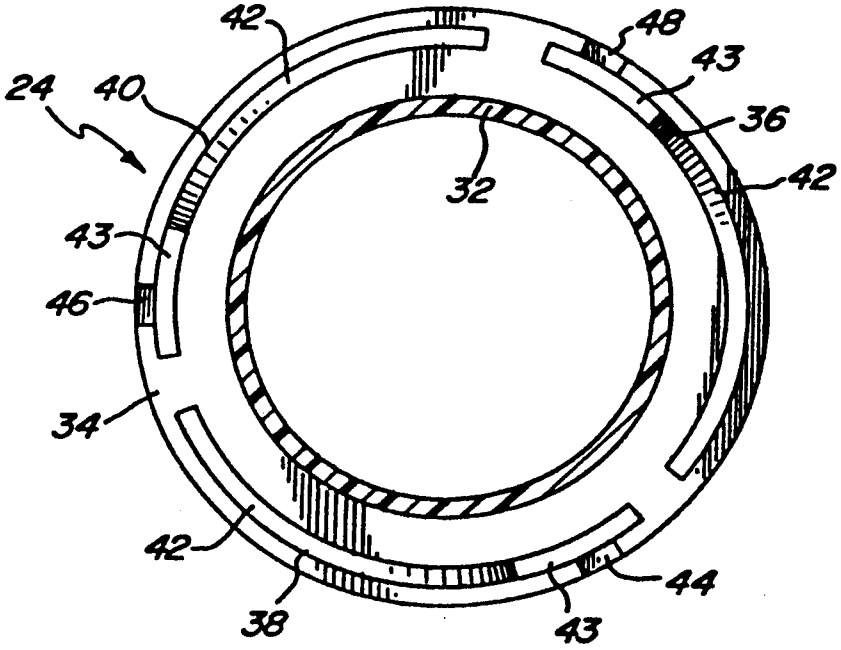
FIG. 3 is a cross-sectional view of the tubular body member of FIG. 2 taken along line 3—3.
Figure 2:
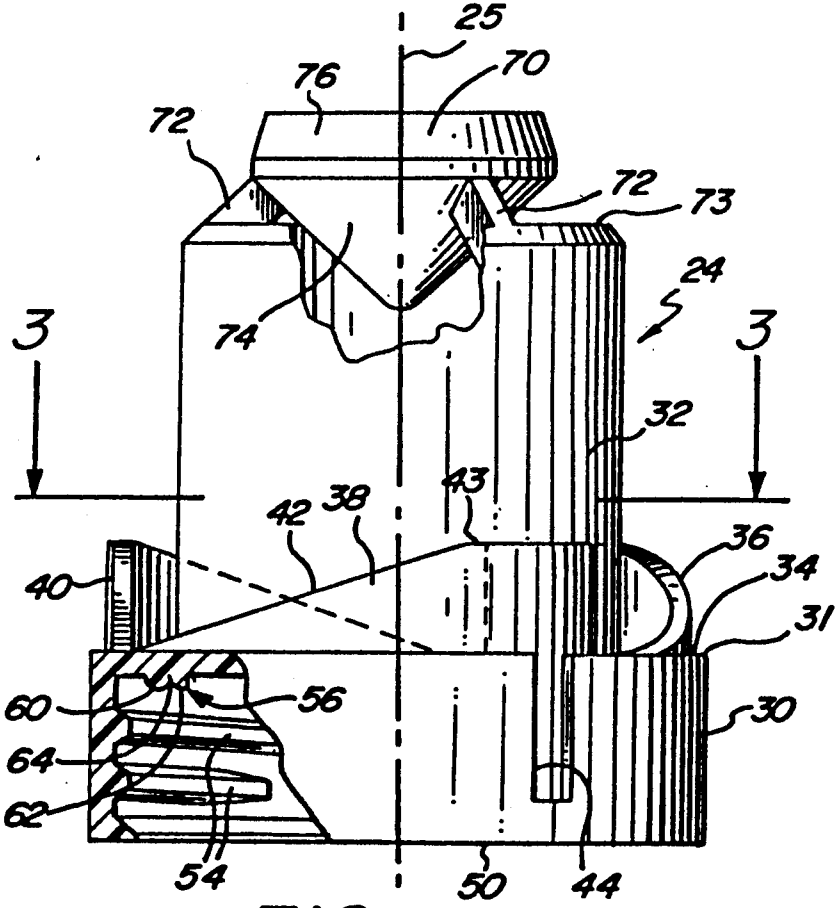
FIG. 2 is a partially broken away side elevational view of a tubular body member employed in the pouring spout of FIG. 1.

FIGS. 2 and 3 illustrate one of the three pouring spout parts, namely, tubular body member 24 which is composed of a cylindrically shaped larger diameter base section 30 and a cylindrically shaped smaller diameter top section 32, both disposed along longitudinal axis 25. The larger diameter base and smaller diameter top sections 30, 32 are joined by an annular shoulder 34 which is substantially perpendicular to the top and base section providing a flat annular surface. Three equally spaced ramps 36, 38, 40 are disposed on annular shoulder 34 in circumscribing relationship to the cylindrically shaped smaller diameter top section 32. Each ramp has a flat angled surface portion 42 which extends upwardly from the annular shoulder 34 to a short flat surface section 43. The three ramps 36, 38, 40 may be spaced inwardly a predetermined distance from the base section annular upper edge 31, the predetermined distance preferably being the depth of the key slots described hereinbelow. The angled flat surface portions 42, 43 provide a cam surface which will complement opposed surface portions of similar ramps in the collar member described below. Three slots 44, 46, 48 are formed in the peripheral cylindrically shaped outer surface of the lower base section 30 extending longitudinally from annular shoulder 34 and terminating a short distance from the bottom 50 of base section 30.

The cylindrically shaped larger diameter base section 30 has internal threads 54 on the inner cylindrically shaped surface thereof which provides a means of attaching the tubular body member to the external threads of a neck of a container. These threads 54 are typically made in standard configurations used in the industry. An annular lip or seal 56 is formed on the inner surface of the shoulder above the threaded section. The seal 56 preferably includes a double arch or beads 60 and 62 joined together by depression 64. Escape or leakage of fluids through a container neck is prevented by the pressure engagement between the neck annular surface and this double bead arrangement.

A stopper member 70 is attached by plurality of ribs 72 to the mouth or pouring end 73 of the cylindrically shaped smaller top section 32. While the stopper member may be of a disk shaped or plug configuration or other suitable shape, a more preferred stopper member structure 70 is illustrated which comprises a cup-shaped member 74 which may have a generally cone shaped outer surface and an annular sealing right 76. The outer surface of the annular sealing ring may have a generally frusto-conical shape which has less taper than the tapered shoulder portion of the spout shaped member 28 to be described below. The cone shaped outer surface of the stopper member cup shaped portion tapers inwardly into the mouth or pouring end of the tubular body member which surface arrangement provides a more laminar type flow to fluids passing through the tubular body member and exiting the pouring end 73 thereof.

Figure 4:
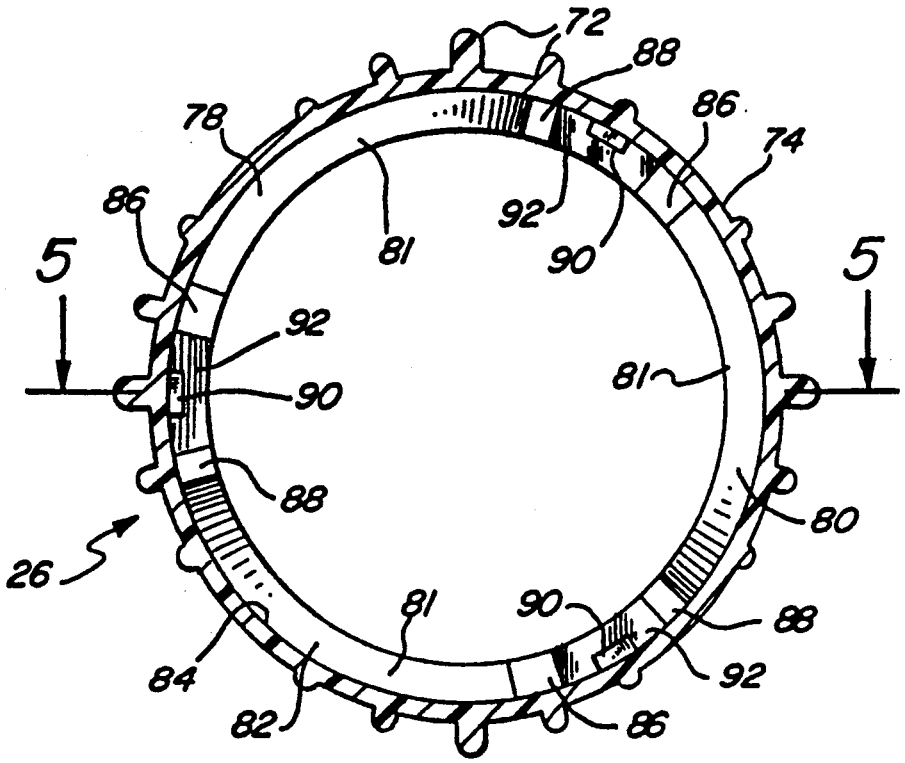
FIG. 4 is a bottom view of a collar member employed in the pouring spout of FIG. 1.
Figure 5:
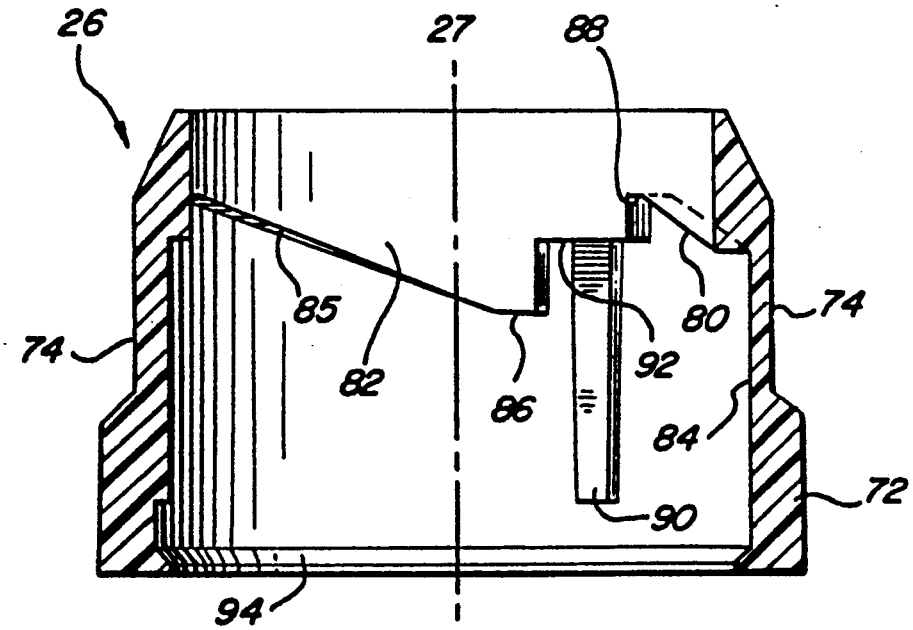
FIG. 5 is a cross-sectional view of the collar member of FIG. 4 taken along line 5—5.

The next component part of the pouring spout arrangement 20, namely collar member 26 is composed of a substantially cylindrically shaped body having a longitudinal axis 27, as illustrated in FIGS. 4 and 5. The collar member 26 has a plurality of elongated ridges 72 or other protuberances extending longitudinally along the outer surface 74 thereof. Three equally spaced ramps 78, 80, 82 are disposed on the cylindrically shaped inner wall 84 of collar member 26. Each ramp has a flat angled surface portion 81 which extend downwardly from upper short flat section 88 to a lower short slightly angled section 86. Square shaped keys 90 extend longitudinally downwardly from each of the flat sections 92 which are intermediately disposed between closely spaced pairs of the upper and lower sections 86 and 88. The square shaped keys 90 have a thickness, or in other words extend inwardly, a distance substantially equal to the depth of the key slots 44 in tubular member 24 and are of substantially the same length as these key slots.

At the bottom of the collar member cylindrically body is an annular inwardly extending retaining lip 94. The annular lip 94 is used in conjunction with the keys to fixedly mount the collar member to the tubular body when assembled. The keys and key slots prevent the collar member from rotating on the tubular body member, thereby keeping the respective opposed complementary ramps of the tubular body and collar members in alignment after assembly, as illustrated in more detail below.

Figure 7:
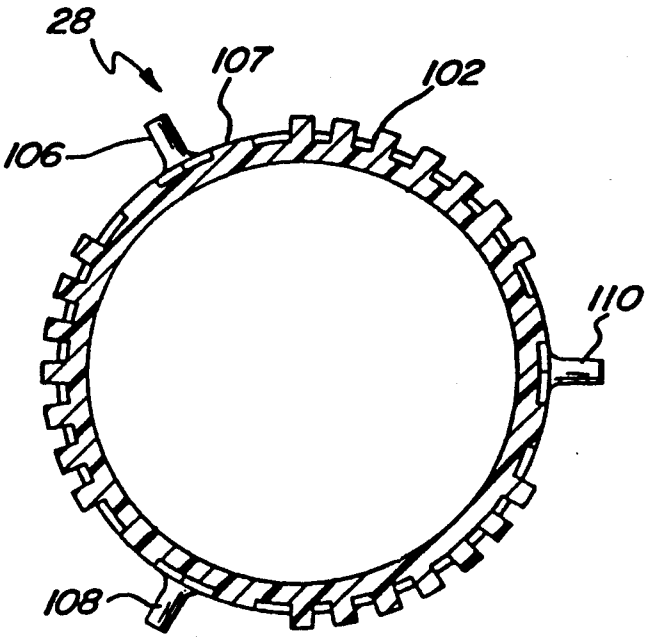
FIG. 7 is a cross-sectional view of the spout shaped member in FIG. 6 taken along line 7—7.
Figure 6:
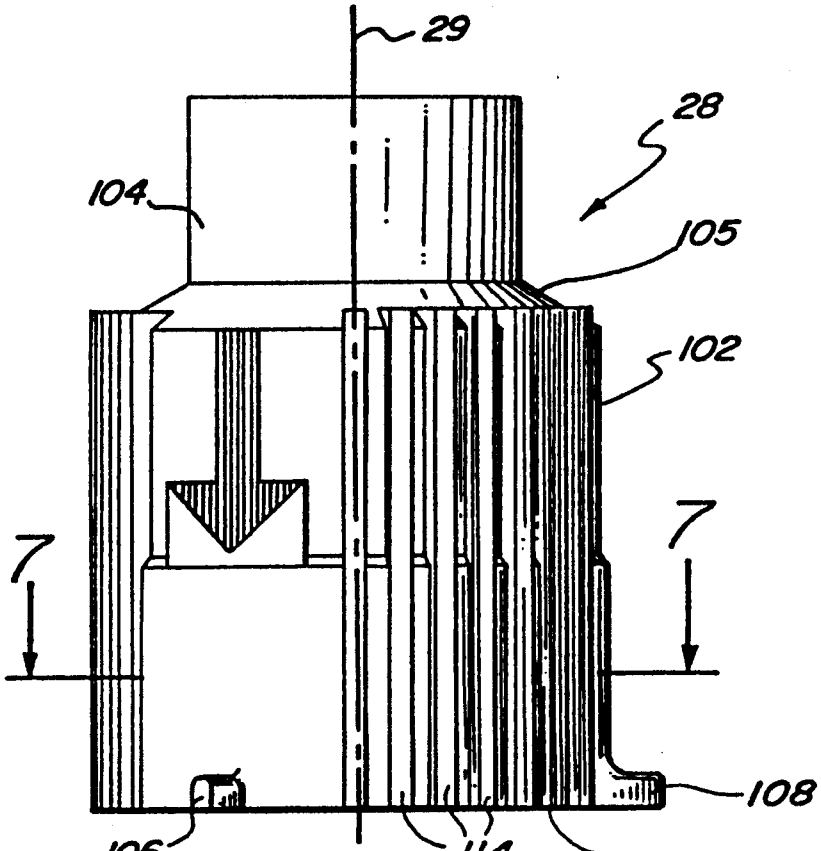
FIG. 6 is a side elevational view of a spout shaped member employed in the pouring spout of FIG. 1.

The third component part of the pouring spout arrangement illustrated in FIGS. 6 and 7, namely spout shaped member 28 is composed of a larger diameter cylindrically shaped lower section 102 of a uniform internal diameter which decreases into a smaller diameter cylindrically shaped upper section 104 of a uniform internal diameter, both disposed along longitudinal axis 29. The upper and lower sections 102 and 104 are joined by annular tapered should section 105. The inner wall of the tapered shoulder preferably has a greater angle of taper than that of the outer surface of sealing ring 76 of the tubular shaped member 32 (shown in FIG. 2) which will thereby provide a tight seal over the entire annular extent of the tapered shoulder when the two sealing surfaces are brought in to contact A cam follower means is provided on the outer surface 107 of the larger cylindrical section 102. The cam follower means comprises three equally spaced lobes or protrusions 106, 108, 110 extending radially outwardly from the outer surface 107 adjacent to the bottom surface 112 of larger diameter lower section 102. A plurality of longitudinally extending ribs or vanes 114 on the outer surface 107 provide structural strength for the spout shaped member as well as providing means for grasping the member.

Figure 8:
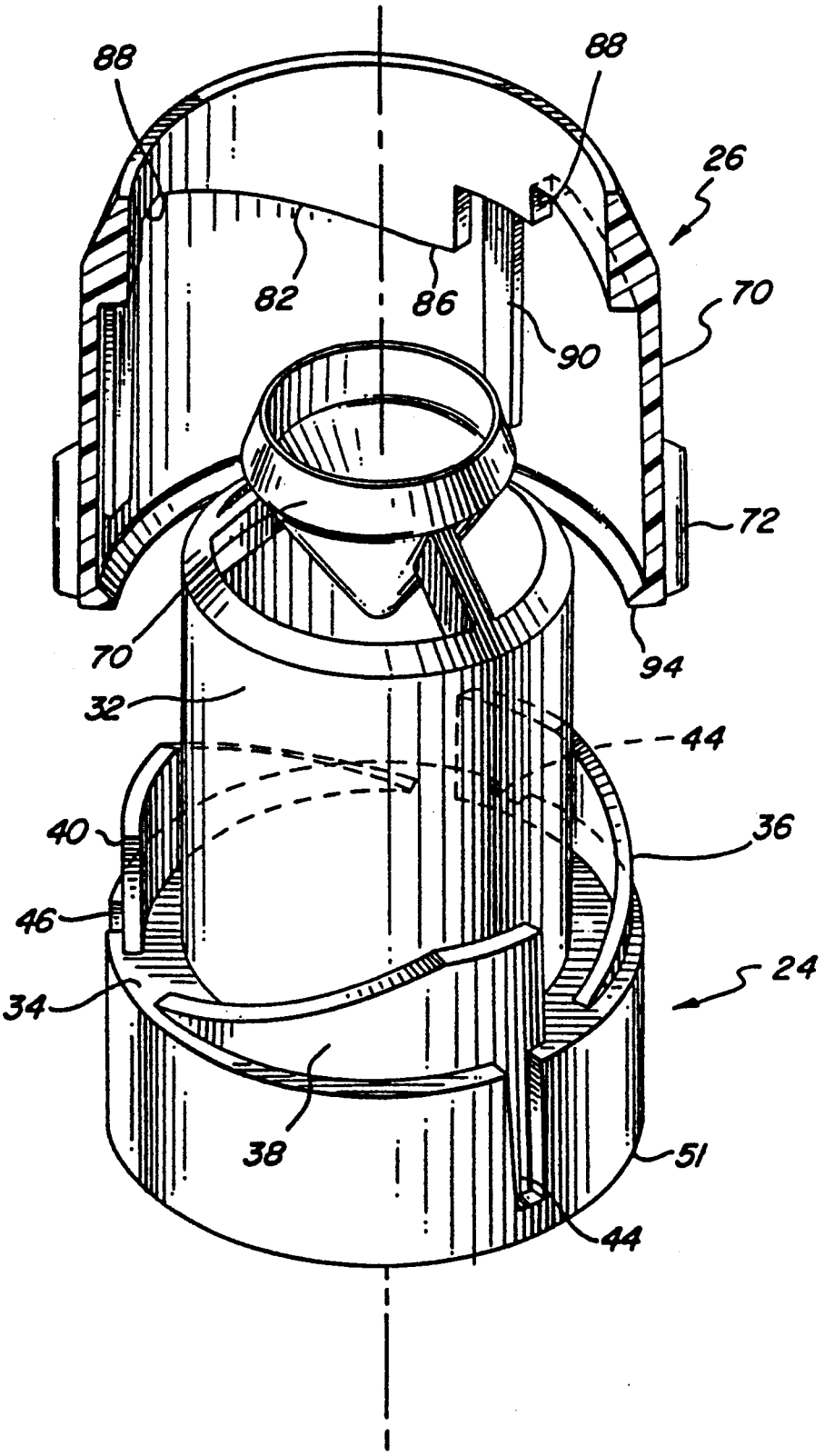
FIG. 8 is a partially broken away perspective view of the tubular body member and collar member.
Figure 9:
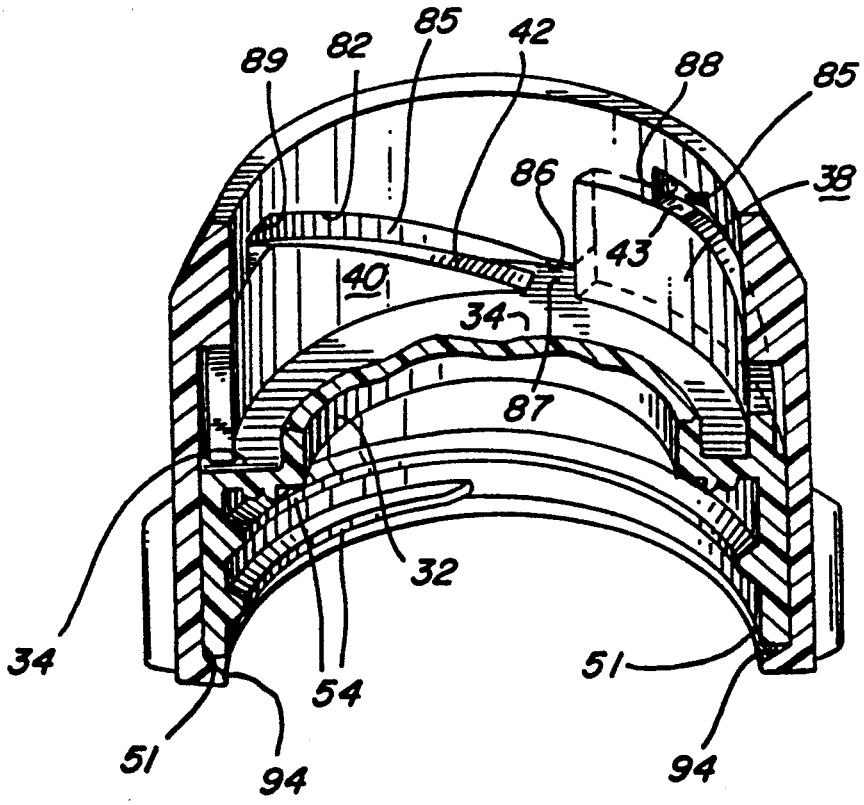
FIG. 9 is a partially broken away cross-sectional view of the tubular body member and collar member assembled together illustrating the unique cam follower means according to the invention.

FIGS. 8 and 9 illustrate more clearly the unique cam follower means in accordance with the principles of the invention. As shown in FIG. 8, one half of the cam follower means is constructed into tubular body member 24 and the other complementary half of the cam follower means into collar member 26. The cam follower means, as described above, preferably takes the form of complementary ramps formed on the tubular body member and collar member which have opposed surfaces forming a slot therebetween. In the example provided in this preferred embodiment, collar member 26 has three downwardly inclined ramps (ramp 82 being shown) and tubular body member 24 has three upwardly inclined ramps 36, 38, 40 of about the same length and having about the same angle of inclination. Constructing the cam follower means of complementary ramps in the two separate members greatly reduces the complexity of the plastic molding process in fabricating the spout and therefore greatly reduces the ultimate cost of the pouring spout 20.

To construct the cam follower means, the collar member 26 is slidably inserted over tubular body member 24, the lip 94 of collar member 26 being snapped over the bottom edge 51 of the tubular body member larger diameter section 30 as illustrated in FIG. 9. The three keys 90 of the collar member slide into key slots 44, 46, 48 in the larger diameter base section. The key and key slots in combination with the lip and base section snapped engagement provide a means to secure or lock the collar member and the tubular body member together in fixed relationship. The assembly of the collar and tubular body member provides for a cam follower means which takes the form of three slots 85. Complementary ramp surfaces of the tubular body and collar members cooperate to form cam follower surface from the two opposed inclined ramp surfaces 42 and 81. The three slots 85 gradually incline from a low point or lower slot section 87 between the upper surface of shoulder 34 and lower slightly angled short section 86, to a high point or upper flat slot section 89 between the top of the tubular member ramp flat section 43 and collar member flat section 88. The low points or lower slot sections 87 correspond to the spout 20 being in a fully closed position where no fluid will flow therethrough, and the high point or upper slot section 89 corresponds to the spout 20 being in a fully open condition.

Figure 11:
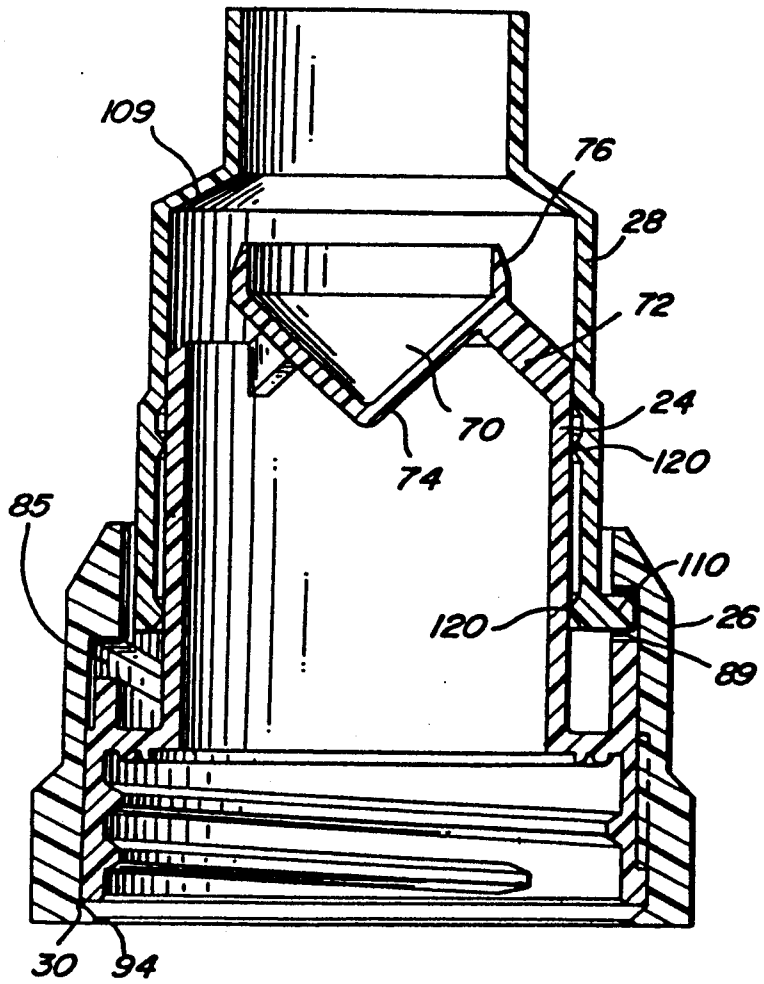
FIG. 11 is a cross-sectional elevational view of the assembled pouring spout in an open position.
Figure 10:
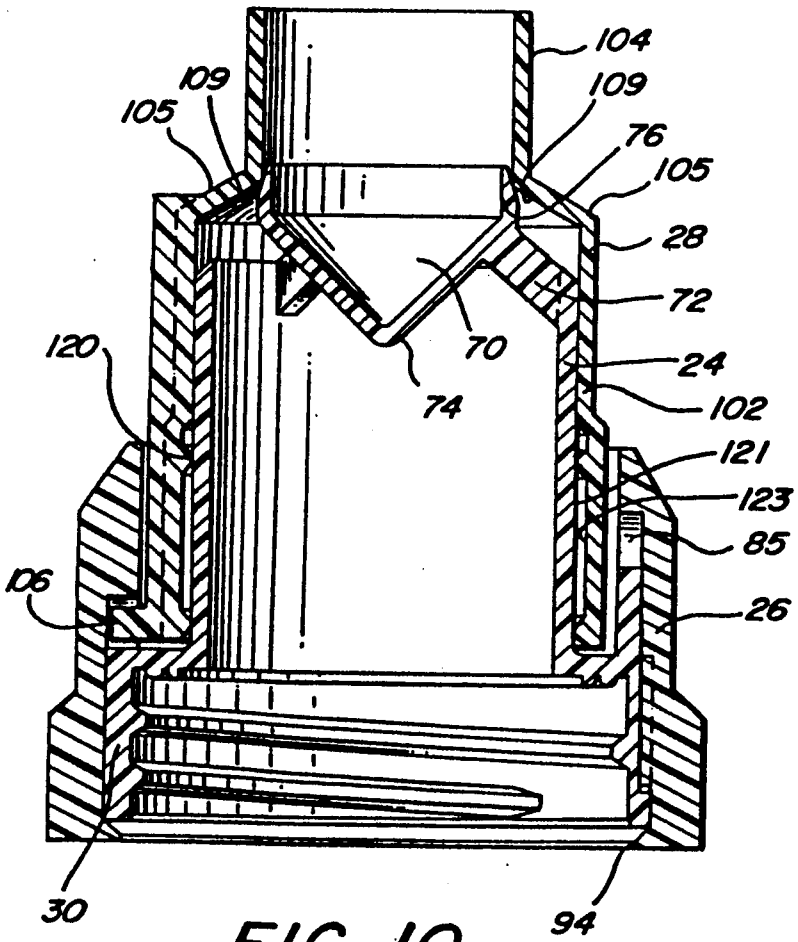
FIG. 10 is a cross-sectional elevational view of the assembled pouring spout in a closed position.

FIGS. 10 and 11 show the spout 20 in fully assembled condition. To assemble the spout 20 from the three above described component parts 24, 26, 28 the spout shaped member 28 is rotatably mounted over the tubular body member 24 smaller diameter top section 32 with respective ones of the spout lobes 106, 108, 110 resting on respective ones of the ramps 36, 38, 40. The collar member 26 is then slidably inserted over the spout shaped member 28 and larger diameter base section 30, and annular ring 94 snapped over the lower edge 51 of the base section. The keys and key slot align the opposed complementary ones of the ramps 36, 38, 40 with the corresponding ones of the ramps 78, 80, 82. The three lobes are slidably contained within slots 85 formed by the complementary ramp pairs. One or more sealing rings may be formed in the inner cylindrically shaped wall of the larger diameter lower section of spout shaped member 28 or on the outer cylindrically shaped wall of the smaller diameter top section 32 of tubular member 24. The sealing ring provides a sealing means to prevent the passing of materials from a container coupled to the spout 20 through the pouring end of the tubular body member from along the external surface thereof toward the attachment end. The sealing means illustrated in FIGS. 10 and 11 are a pair of annular projecting ridges 120 disposed around the interior cylindrically shaped wall 123 of the spout shaped member 28 larger diameter lower section 104 which sealingly engage the outer cylindrically shaped wall 121 of the smaller diameter top section 102 of tubular body member 24.

Operation of the spout arrangement will now be described in detail with reference to FIGS. 10, 11 and 12.

Figure 12:
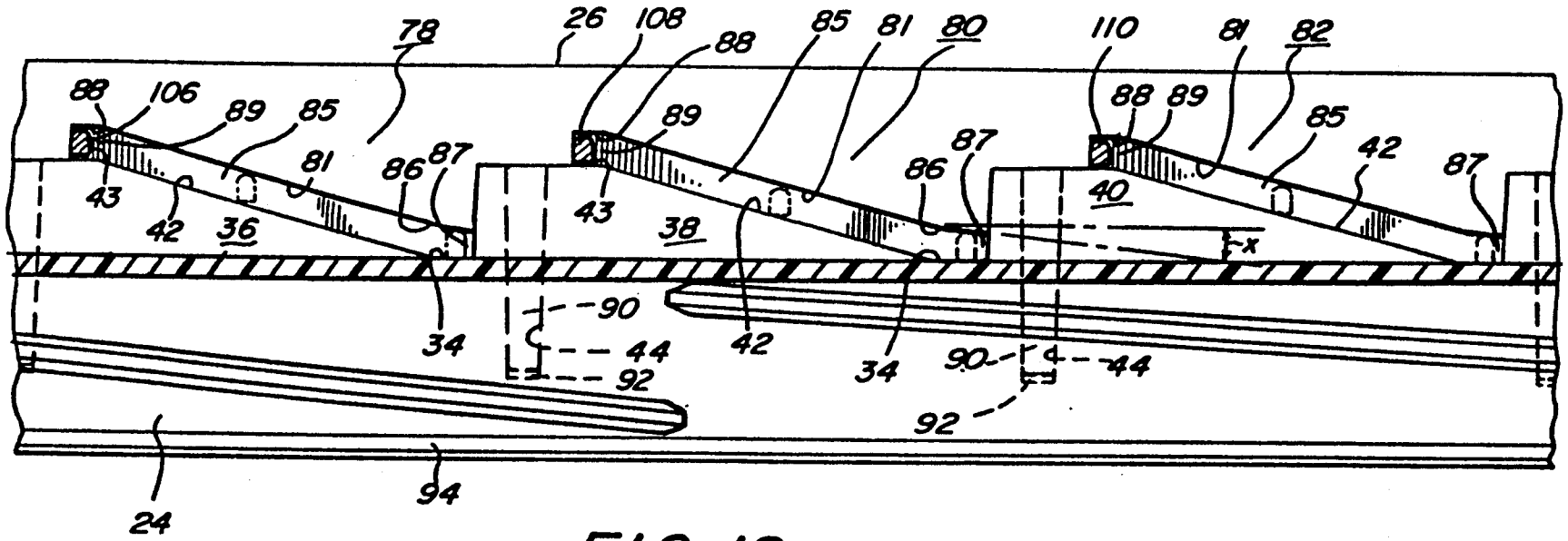
FIG. 12 is a stretch out view illustrating the cam follower which is formed cooperatively by the tubular body member and collar member.
Figure 14:
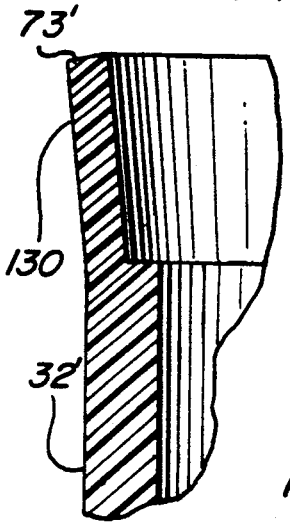
FIG. 14 is a cross-sectional view of a portion of the tubular shaped member of FIG. 13 taken along lines 14—14 illustrating the flared sealing rim thereof.
Figure 13:
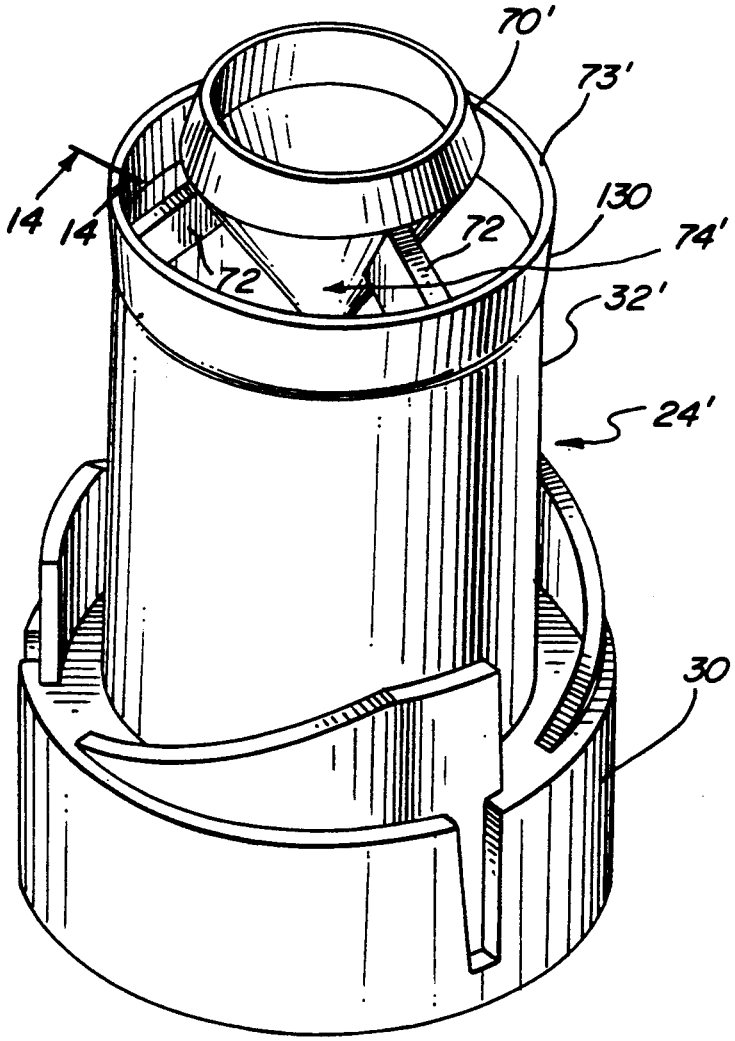
FIG. 13 is a perspective view of the tubular shaped member in accordance with an alternative embodiment of the sealing arrangement of the present invention.

FIG. 12 is a stretch out view of the cam follower means illustrating the lobes 106, 108, 110 in three different locations of travel along slots 85. FIG. 10 shows the pouring spout in its fully closed position, and FIG. 11 illustrates the pouring spout 20 in its fully open position. To achieve the fully closed position, the spout shaped member 28 is rotated downwardly, the lobes 106, 108, 110 traversing downwardly within the inclined slots 85 until the lobes enter and lock in to the lower flat slot section 87 by frictional engagement with collar member slightly angled surface portion 86. At this point, the annular sealing ring portion 76 of stopper member 70 engages the inner annular corner 109 of spout shaped member 28 where the smaller diameter upper section and tapered shoulder 105 of the spout shaped member 28 meet, and the lobes 106, 108, 110 each press upwardly against the upper surfaces 86 of their respective lower slot sections 87. The opposed upward pressure of the lobes against the ramp surfaces 86 and downward pressure of the tapered shoulder against the sealing ring effectively locks the spout shaped member 28 in a fully closed position. The lower slightly angled short section 86 has a relatively small angle of taper "x" preselected such that the lobes will cinch against this short section and the stopper against the spout shaped member before the lobes reach the end wall of the lower slot sections 87. The sealing ring and tapered shoulder form an annular seal closing off the pouring mouth of the tubular member. The annular ring may be made of relatively thin and of relatively pliable and resilient material such that it may be deformed slightly to conform to any minor irregularities on the structure and thus provide a good seal To open the spout for a pouring operation, the spout shaped member 28 is rotated or turned such that the three lobes 106, 108, 110 traverse upwardly in their respective slots and enter the upper flat slot section 89, as shown in FIG. 11. On tipping the container as illustrated in FIG. 1, liquid contents flow through tubular body member 24 and out the pouring end or mouth thereof provided by ribs 72, and over the cup-shaped stopper and out the smaller diameter section 104 of spout shaped member 28. The amount of fluid flow can be regulated by rotating the spout shaped member to any intermediate position.

An important advantage of the present invention is the three piece construction and its simplicity rendering it highly desirable for plastic molding by conventional machines at low cost. The collar member may be provided with indicia in the form of "ON" and "OFF" labels and the spout shaped member with an arrow which cooperatively when aligned indicate that the spout 20 is in either a fully open condition or fully closed position as shown in FIG. 1.

Figure 15:
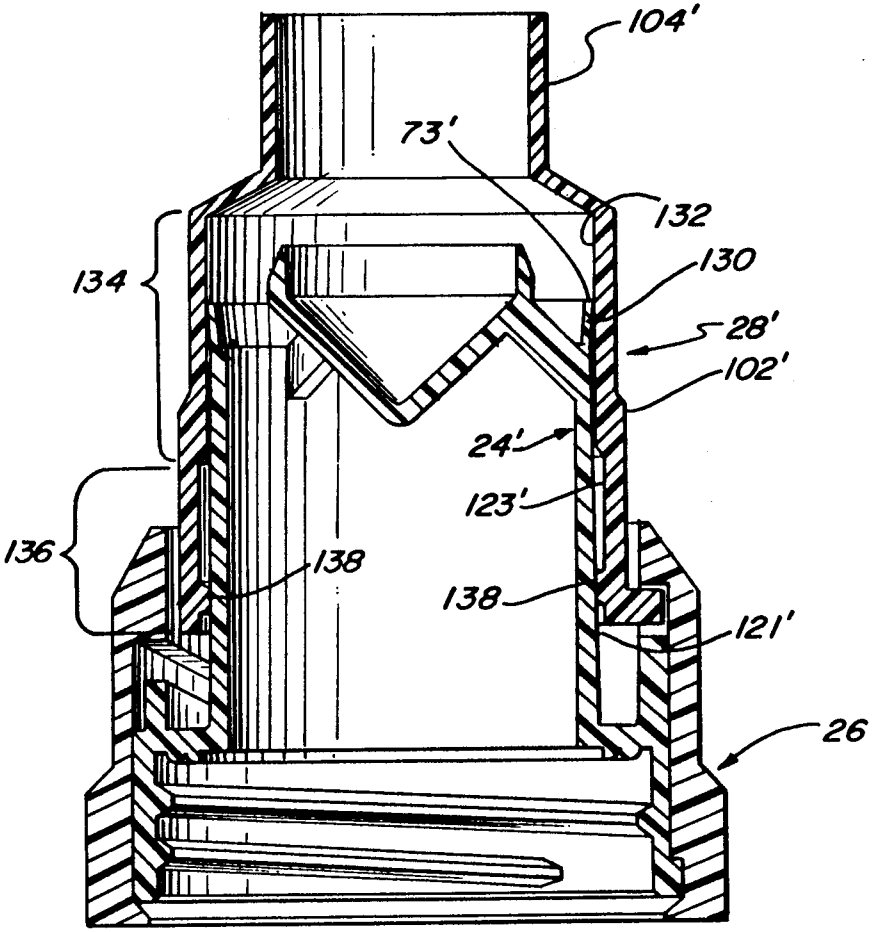
FIG. 15 is a cross-sectional view of the assembled spout containing a tubular body member of FIG. 13 and a modified spout shaped member in an open position.
Figure 16:
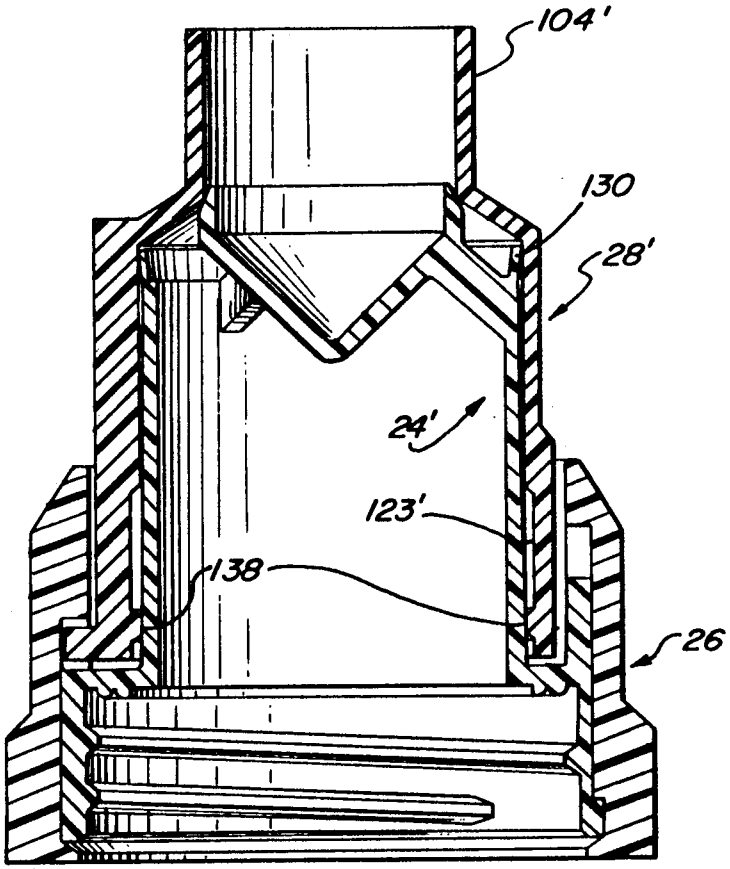
FIG. 16 is a cross-sectional view of the spout of FIG. 15 in a closed position.

A preferred sealing arrangement for preventing material from leaking between the tubular body member and the spout shaped member toward the collar is illustrated in FIGS. 13–16 where elements of the pouring spout parts in common with those illustrated in the preceding figures are designated by primed numerals. The pouring end 73' of the tubular body member 24' (FIGS. 13 and 14) is flared outwardly to provide a flange 130 which extends beyond the diameter of the top cylindrical section 32'. The outer surface of the flared pouring end or flange rim 73' of the tubular body member 24' is biased against and thus in sliding engagement with the inner cylindrical wall 132 of the upper portion 134 of the top section 102' of the spout shaped member 28' as is illustrated in FIGS. 15 and 16.

The top section 102' of spout shaped member includes a lower portion 136 having an inner cylindrical wall 123' of a greater diameter than the cylindrical surface 132 to permit the tubular body member 24' and its flared rim 73' to be easily inserted into the spout shaped member 28' during assembly. An inwardly projecting annular ridge or ring 138 on the inner wall 123' of the spout shaped member slidably engages the outer wall 121' of the top section 102' of the tubular body member 24' to keep the members aligned along a common axis (or maintain concentricity).

The above-described detailed description of the preferred embodiments described the best mode contemplated by the inventors for carrying out the present invention at the time this application was filed and is offered by way of example and not by way of limitation. Accordingly, various modifications may be made to the above-described preferred embodiment without departing from the scope of the invention. Accordingly, it should be understood that although the invention has been described and shown for a particular embodiment, nevertheless various changes and modifications obvious to a person of ordinary skill in the art to which the invention pertains are deemed to lie within the spirit and scope of the invention as set forth in the following claims.

What is claimed:

1. A rotatable closure structure for attachment to container bottles and the like, comprising:

a tubular body member having an attachment end and a pouring end, the attachment end having means for securing the tubular body member to a container bottle;

a collar member fixedly mounted on the tubular body member adjacent to the attachment end thereof, the collar member and tubular member cooperatively defining a cam surface therebetween; and a spout shaped member rotatably mounted on the tubular body member, the spout shaped member having an outlet end through which material to be dispensed from the container flows, the spout shaped member having a cam follower which engages the cam surface so that rotation of the spout shaped member in one direction causes the outlet end thereof to move toward the pouring end of the tubular body member and rotation of the spout shaped member in the other direction causes the spout shaped member to move away form the pouring end of the tubular body member, the tubular body member and spout shaped member having cooperative closure means responsive to the movement of the outlet end of the funnel member toward and away form the pouring end of the tubular body member for closing and opening the pouring end of the tubular body member, the tubular body member and the spout shaped member defining sealing means therebetween to prevent the passing of material from the container through the pouring end of the tubular body member from along the exterior surface of the tubular body member toward the attachment end thereof.

2. The rotatable closure structure of claim 1 wherein the sealing means comprises an outwardly projecting flange on the tubular body member adjacent the pouring end thereof, the flange being arranged to slidably engage the inner surface of the spout shaped member.

3. The rotatable closure structure of claim 2 wherein the spout shaped member defines a first inner cylindrical surface of substantially constant diameter which is engaged by the flange on the tubular body member.

4. The rotatable closure structure of claim 3 wherein the spout shaped member further defines a second inner cylindrical surface extending from adjacent the first cylindrical surface toward the attachment end thereof, the second cylindrical surface having a greater diameter than the first cylindrical surface.

5. The rotatable closure structure of claim 4 wherein the spout shaped member defines an annular ridge extending inwardly from the second cylindrical surface for engaging the outer surface of the tubular body member for maintaining concentricity between the spout shaped and tubular body members.

6. The rotatable closure structure defined in claim 5 wherein the tubular body member includes a larger diameter cylindrical base section at the attachment end and a smaller diameter top section at the pouring end thereof, the spout shaped member having a lower cylindrical section which surrounds the tubular body member smaller diameter to section and an upper smaller diameter cylindrical section at the outlet end and a tapered section joining the upper and lower sections, and wherein the closure means comprises a stopper member having an annular sealing surface mounted on the pouring end of the tubular member for sealingly engaging the tapered section of the spout shaped member when the outlet end of the spout shaped member is moved toward the pouring end of the tubular body member, the maximum distance allowed by the cam surface and cam follower.

7. A rotatable closure structure for releasable attachment to container bottles and the like, comprising:

an inner tubular body member having a pouring end and an attachment end and also an inner annular surface and further having threads on said inner annular surface at the attachment end to engage complementary threads on the container to secure the inner tubular member thereto;

an outer collar member having an inner cylindrically shaped surface, said outer collar member fixedly mounted on the inner tubular member, the inner tubular member and outer collar member defining therebetween a cam slot;

a rotatable tubular spout member having two ends, one end having a cam follower means, said spout member being slidably inserted over said inner tubular member such that said cam follower seats into said cam slot so that rotation of the spout member relative to the inner tubular member and collar member causes the spout member to move toward and away from the pouring end of the inner tubular member, the inner tubular member and spout member having cooperating closure means responsive to the movement of the spout member toward and away from the pouring end for varying the size of the opening between said inner tubular member and said spout member from a fully closed to a fully open position, the cam slot including at least one relatively low angular segment for causing the cam follower to latch the closure means in fully closed position; and sealing means for preventing material from leaking along the exterior surface of the tubular member toward the attachment end thereof, the sealing means comprising a outwardly projecting flange on the pouring end of the tubular body member and cylindrical inner surface on the spout member, the flange being resiliently biased against said inner surface of the spout member to provide a sliding seal engagement as the spout member moves toward and away from the pouring end of the tubular body member.

* * * * *